United States Patent [19]

Sekiguchi et al.

[11] Patent Number: 4,923,310

[45] Date of Patent: May 8, 1990

[54] DISTRIBUTING CONNECTOR

[75] Inventors: Yoshichika Sekiguchi, Mooka; Hideaki Kodama, Sagamihara, both of Japan

[73] Assignees: Daiichi Denshi Kogyo Kabushiki Kaisha; Iwatsu Electrical Co., Ltd., both of Japan

[21] Appl. No.: 383,195

[22] Filed: Jul. 20, 1989

[30] Foreign Application Priority Data

Jul. 27, 1988 [JP] Japan ..... 63-98394[U]

[51] Int. Cl.[5] ..... H01R 13/502

[52] U.S. Cl. ..... 439/701; 439/752; 439/540; 439/715

[58] Field of Search ..... 439/696, 701, 695, 710–718, 439/449, 733, 752, 892, 540

[56] References Cited

U.S. PATENT DOCUMENTS

| | | | |
|---|---|---|---|
| 3,148,929 | 9/1964 | Gordon | 439/701 |
| 3,173,734 | 3/1965 | Hartwell | 439/532 |
| 4,358,178 | 11/1982 | Guy | 439/464 |
| 4,483,580 | 11/1984 | Pelczarski | 439/460 |
| 4,596,436 | 6/1986 | Kraemer et al. | 439/701 |
| 4,659,166 | 4/1987 | Morningstar et al. | 439/696 |

FOREIGN PATENT DOCUMENTS

| | | | |
|---|---|---|---|
| 1392634 | 2/1965 | France | 439/717 |

OTHER PUBLICATIONS

IBM Tech. Disclosure Bulletin, "Linear Array Connector", K. R. Dust; p. 108, vol. 15, No. 1, Jun. 1972.

*Primary Examiner*—David Pirlot

*Attorney, Agent, or Firm*—Silverman, Cass & Singer, Ltd.

[57] ABSTRACT

A distributing connector includes a collective receptacle having a plurality of unit receptacle connectors, and plug connectors to be fitted in the unit receptacle connectors, respectively. The distributing connector includes a U-shaped plug connector receiving cover for receiving bases of the plug connectors, and a U-shaped back cover for receiving wires. The receiving cover has openings for receiving fitting portions of the plug connectors arranged correspondingly to the unit receptacle connectors of the collective receptacle and back cover mounting ribs along outer edges of an opening of the U-shaped cover. The back cover has grooves along outer edges of an opening of the U-shaped back cover for receiving said back cover mounting ribs of the plug connector receiving cover and plug connector retaining ribs along inner edges of said opening of the U-shaped back cover. When the plug connectors are fitted in the collective receptacle, the plug connectors are aligned and fixed by embracing by edges of the openings of the receiving cover and the plug connector retaining ribs.

8 Claims, 5 Drawing Sheets

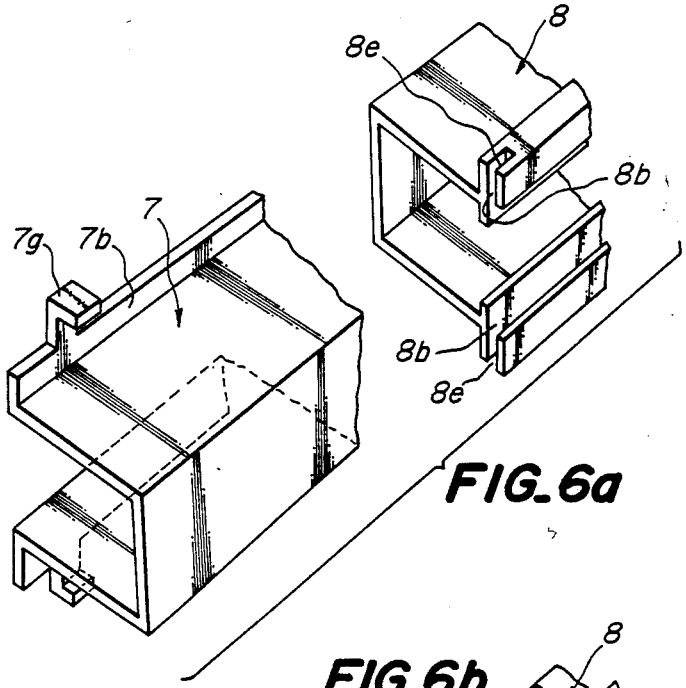
FIG_6a
FIG_6b
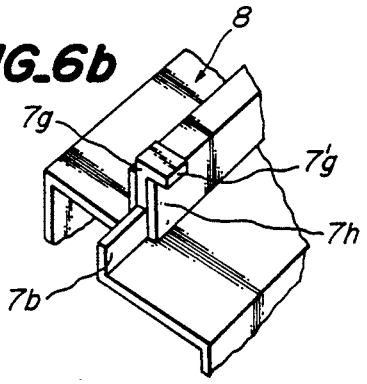
FIG_6c
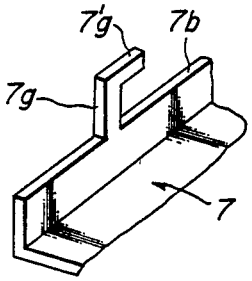
FIG_6d
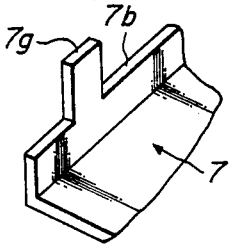
FIG_6e
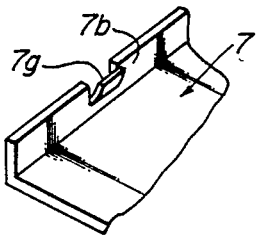

DISTRIBUTING CONNECTOR

BACKGROUND OF THE INVENTION

This invention relates to a distributing connector for use in a telephone exchanger, and more particularly to aligning device for plug connectors of distributing connectors for connecting between section party telephones within a station yard and telephones of extensions.

In case that a telephone of an extension is connected to an exchanger in a station yard, there are provided a certain number (capable of connecting all circuits) of receptacle A connected to printed circuit boards P of the exchanger and having, for example, eight unit receptacle connectors $A_1$, $A_2$, $A_3$, . . . , $A_8$ integrally aligned therein as shown in FIG. 1. The number (corresponding to the unit receptacle connectors) of plug connectors B connected to the telephones, respectively, are inserted into the unit receptacle connectors, respectively, to connect the exchanger and the respective telephones. Moreover, if required, in such a case of transferring telephones, it is possible to change the extension numbers by inserting the plug connectors B into different unit receptacle connectors.

Referring to FIG. 1, the receptacle A includes contacts 2 aligned and fixed in fitting cavities 1 and mounting flanges 3 for mounting the receptacle A to a print circuit board P with the aid of apertures 3*a*. The plug connector B includes a base portion 4 and a fitting portion 5 having a sectional area smaller than that of the base portion 4. The plug connector B further includes steps 4*a* for regulating inserted position of the plug connector B into the fitting cavity 1 of the receptacle A and contacts 6.

Recently, circuits for one exchanger have been going on increasing so that as many as 400 circuits for one exchanger are often used. Therefore, the procedure that the plug connectors are individually gathered together and inserted into the receptacle A so as to be connected thereto is time-consuming and troublesome because the collective receptacle connected to print circuit boards are often positioned at a location which are narrow and difficult to see due to miniaturization of the exchanger. Moreover, the plug connectors are often inserted into wrong receptacle connectors to give rise to confusions such as incorrect extension numbers.

SUMMARY OF THE INVENTION

It is an object of the invention to provide an improved distributing connector capable of simply aligning and fixing plug connectors of the number corresponding to the number of unit receptacle connectors of a receptacle so as to be inserted into the receptacle connectors by a single operation.

It is another object of the invention to provide a distributing connector capable of simply aligning plug connectors corresponding to respective unit connectors of a collective receptacle only by inserting the plug connectors into a housing casing to fit mounting ribs into rib receiving grooves, thereby enabling the plug connectors to be simultaneously connected or disconnected.

It is a further object of the invention to provide a distributing connector capable of simply removing the above aligning and fixing of the plug connectors to bring them into independent conditions so that inserted positions of the plug connectors are easily changed so as to change extension numbers when it is desired.

It is an object of the invention to provide a distributing connector whose connecting wires are prevented from separating and breaking by providing a back cover covering the connecting wires to protect them from external forces.

In order to accomplish these objects, a distributing connector including a collective receptacle having a plurality of unit receptacle connectors, and plug connectors to be fitted in the unit receptacle connectors, respectively, according to the invention comprises a plug connector receiving cover having a U-shaped cross-section forming a plug connector base receiving portion for receiving bases of the plug connectors and having plug connector positioning openings for receiving fitting portions of the plug connectors arranged correspondingly to the unit receptacle connectors of the collective receptacle and back cover mounting ribs along outer edges of an opening of the U-shaped cover, and a back cover including a wire receiving portion having a U-shaped cross-section, back cover mounting rib receiving grooves along outer edges of an opening of the U-shaped back cover for receiving said back cover mounting ribs of the plug connector receiving cover and plug connector retaining ribs along inner edges of said opening of the U-shaped back cover, thereby after inserting the plug connectors into the plug connector receiving cover, fitting said back cover mounting ribs of the plug connector receiving cover in the back cover mounting rib receiving groove of said back cover to embrace the bases of the plug connectors by means of edges of said plug connector positioning openings and the plug connector retaining ribs, thereby aligning and fixing the plug connectors.

With this arrangement according to the invention, by previously aligning and fixing plug connectors in the order of numbers indicated on a receptacle on the side of an exchanger before inserting the plug connectors, it is possible to eliminate the difficulties such as troublesome and time-consuming operations which would occur when plug connectors are individually inserted into a collective receptacle. Moreover, the distributing connector according to the invention can prevent lead wires from being erroneously connected and more improve ease in handling of the connector.

The invention will be more fully understood by referring to the following detailed specification and claims taken in connection with the appended drawings.

BRIEF DESCRIPTION OF THE DRAWINGS

FIGS. 6*a*–6*e* are partial perspective views for explaining stoppers for a back cover of the connector according to the invention.

PREFERRED DESCRIPTION OF THE PREFERRED EMBODIMENTS

Referring to FIG. 2, a plug connector receiving cover 7 of the distributing connector according to the invention comprises a connector base receiving portion 7*a* having a U-shaped cross-section whose height corresponding to a length of a base 4 of plug connector and a width also corresponds to that of the base 4. Moreover, a length of the plug connector receiving cover 7 is so selected that plug connectors are received whose number corresponds to that of unit connectors of a collective receptacle A and whose intervals correspond to those of the unit connectors of the collective receptacle A.

Figure 1:
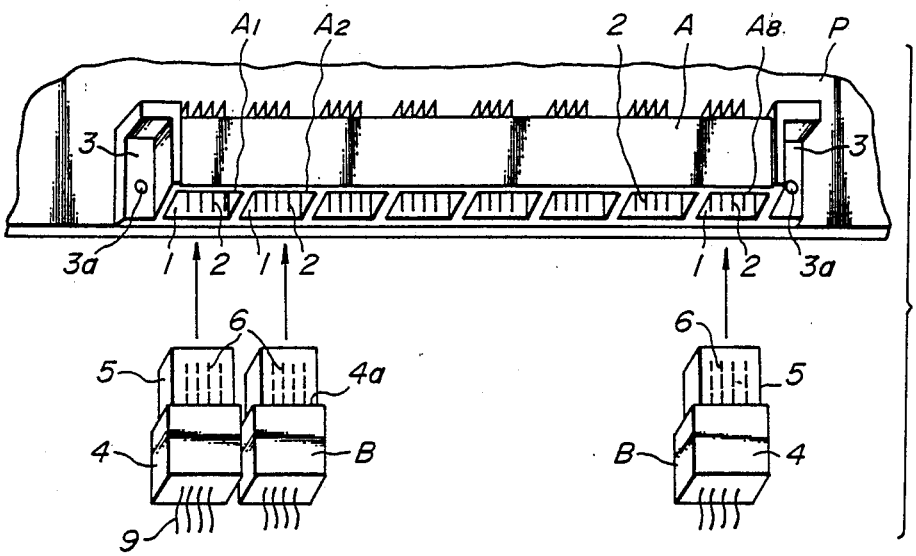
FIG. 1 PRIOR ART
FIG. 1 is a perspective view for explaining connections between telephones and an exchanger according to the prior art.
Figure 2A:
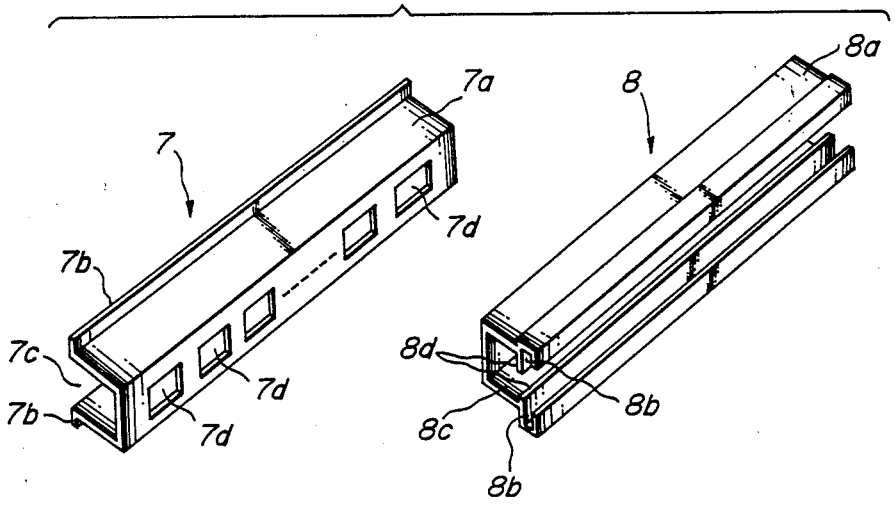
FIG. 2*a* is an exploded perspective view of one embodiment of a connector according to the invention.
Figure 2B:
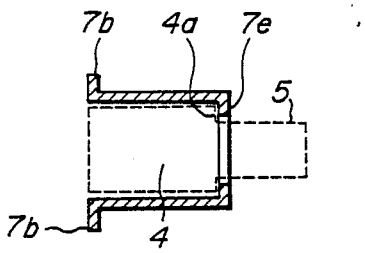
FIG. 2*b* is a sectional view of a plug connector receiving cover shown in FIG. 2*a*.

The plug connector receiving cover 7 is formed with plug connector positioning openings 7*d* for positioning the plug connectors, respectively, each of the openings 7*d* having a size for receiving a fitting portion 5 shown in phantom lines in FIG. 2*b* without play. Abutment surfaces 7*e* formed on circumferences of the opening 7*d* regulate shoulders 4*a* between the base and fitting potions 4 and 5.

However, it is preferable to provide a slight play between the opening 7*d* and the fitting portion 5 of the plug connector B so as to make smooth the insertion and fitting of the plug connector B in the receptacle connector A. It is better that the plug connector B is smoothly introduced into the receptacle connector A with some play between the fitting cavity and the fitting portion 5 rather than that the plug connector is rigidly fixed to the plug connector receiving cover 7 to make pitches of the fixed plug connectors coincident with pitches of the fitting cavities 1 of the receptacle connector A with a great difficulty.

The plug connector receiving cover 7 is formed with back cover mounting ribs 7*b* which are formed by folding edges of free ends of legs of the U-shape outwardly along axial direction of the cover 7. In this embodiment, widths of the ribs 7*b* in a lateral direction of a longitudinal axis of the cover 7 are approximately 1.2 mm, while a width of a connector inserting opening 7*c* of the cover 7 is about 7 mm in the lateral direction.

The plug connector receiving cover 7 is made of a stainless steel plate having a thickness of about 0.6 mm by punching by means of a press and bending. However, it may of course be made by other method. For example, it may be made of an aluminum alloy by die-casting.

A back cover 8 shown in FIG. 2*a* serves to fix the plug connectors B and also to protect connecting wire from external disturbances. The back cover 8 comprises a wire receiving portion 8*a* having a U-shaped cross-section whose depth and length are so selected that connecting wires for connecting between the respective plug connectors and telephones of extension lines are received therein and the length is substantially equal to or more than total length of the plug connectors in a row to be received in the plug connector receiving cover 1.

The back cover 8 is formed with grooves 8*b* for receiving the back cover mounting ribs 7*b* of the plug connector receiving cover 7. The grooves 8*b* are arranged along edges of an opening 8*c* of the back cover 8. The back cover 8 is further formed with plug connector retaining ribs 8*d* adjacent the grooves 8*b* inwardly of the opening 8*c*.

Figure 5C:
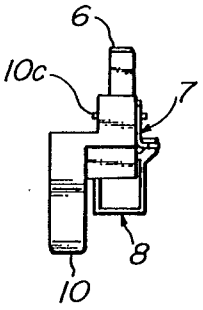
FIG. 5*c* is a side view of the connector of FIG. 5*a*.
Figure 5A:
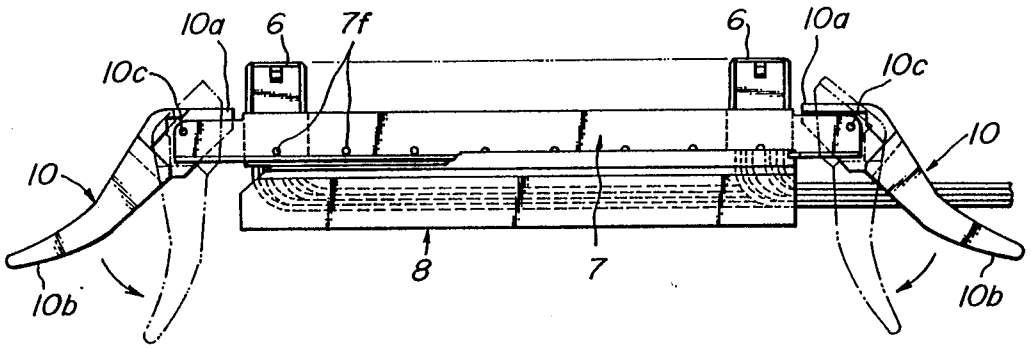
FIG. 5*a* is a plan view of an embodiment including eight plug connector.
Figure 5B:
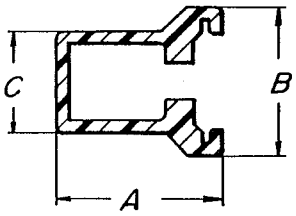
FIG. 5*b* is a sectional view taken along an inserting direction of plug connectors.

A cross-section of the back cover is shown in FIG. 5*b*. In this embodiment, A, B and C are 16 mm, 12 mm and 9 mm, respectively. The back cover is made of polypropylene resin by injection molding. Other resins such as polyamide may be used.

A distance between the grooves 8*b* of the back cover 8 is 5% smaller than a distance between the back cover mounting ribs 7*b* of the plug connector receiving cover 7. With such a dimensional relation, when the ribs 7*b* of the receiving cover 7 are received in the grooves 8*b* of the back cover 8, the back cover 8 is deformed with its dimension B being slightly expanded so as to embrace the receiving cover 7 so that the back cover 8 is effectively fixed relative to the receiving cover 7.

The receiving cover 7 and the back cover 8 as above described are handled as follows.

Figure 3:
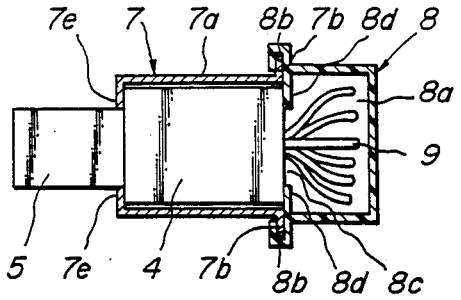
FIG. 3 is a sectional view taken along inserting directions of plug connectors of the embodiment.
Figure 4A:
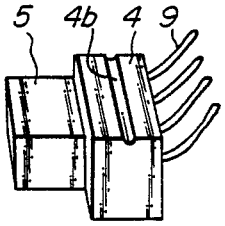
FIGS. 4*a* and 4*b* are a perspective and a sectional views taken along an inserting direction for explaining temporarily retaining means.
Figure 4B:
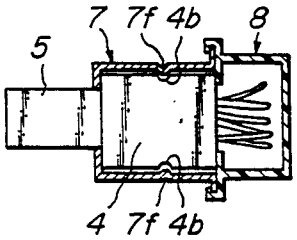

The respective plug connectors whose connecting wires are connected to the telephones in extension lines are inserted in the receiving cover 7 in the order that predetermined numbers of extension are obtained. The plug connectors are further inserted into the plug connector positioning openings 7*d* until steps or shoulders 4*a* of the plug connectors abut against the abutment surfaces 7*e* of the receiving cover 7. Connecting wires 9 of the plug connectors are then snugly arranged along the lengthwise of the receiving cover 7. Thereafter, the back cover 8 is mounted on the receiving cover 7 by sliding the back cover 8 along the receiving cover 7 from one side with ribs 7*b* being fitted in the grooves 8*b* as shown in FIG. 3.

The plug connectors B can be arranged with predetermined intervals in one row by the abutment surfaces 7*e* of the receiving cover 7 and the plug connector retaining ribs 8*d* embracing the plug connector B in this manner. Moreover, the receiving cover and the back cover 8 are released from each other to remove the plug connectors B from these covers 7 and 8 in steps reverse to the steps above described into an independent condition. Thereafter, exchanging the numbers of extensions or the like can be effected.

In the event that the back cover 8 is removed from the receiving cover 7 to release the arrangement of the plug connectors B, connectors other than those required to be exchanged are also released so as to be jumped out of the receiving cover 7, so that the changing operation becomes often difficult. In order to remove such a difficulty, each of the plug connectors B is formed with temporarily retaining groove 4*b* provided in a surface of the base 4 and inwardly extending perpendicularly to fitting and connecting directions of the connectors. And the receiving cover 7 is provided with temporarily retaining shallow projections 7*f* formed in an inner surface of the receiving cover 7 by for example punching and in opposition to the groove 4*b* of the each of the plug connectors B. The respective plugs connectors B are retained in the receiving cover 7 by engagement of the projections 7*f* of the receiving cover 7 and the grooves 4*b* formed in the base portions 4 of the plug connectors B to an extent such that the plug connectors B can be easily manually removed from the receiving cover 7.

When a number of the plug connectors B is used, it becomes difficult to remove them from the receiving cover 7 because of increased forces required to the removal. This problem can be solved by providing levers for removing the plug connectors. As shown in FIG. 5*a*, removing levers 10 each consisting of a relatively short and thick removing portion 10*a* and a longer urging portion 10*b* extending substantially in opposite directions are pivotally connected to the receiving cover 7 by means of pins 10*c*.

When the plug connectors B are inserted into the receptacle connector A, the removing portions 10*a* are received in the receiving cover 7 as shown in solid lines in FIG. 5*a*. On the other hand, when the removal of the plug connectors is required, the urging portions 10*b* of the levers 10 obliquely outwardly extending as shown in solid lines are urged inwardly in directions shown in arrows so as to extend the removing portions 10*b* in the directions inserting the plug connectors B into positions shown in phantom lines.

In the embodiment shown in FIG. 5*a*, a ratio of lever lengths between the removing portion 10*a* and urging portion 10*b* of the removing lever 10 is 1:4. The removing lever 10 is made of polybutylene terephthalate. The removing levers 10 are effective for the present invention.

When the plug connectors B are inserted into the receptacle A, it is only required to force the plug connectors into the receptacle A so as to be coincident with positions in the receptacle A. In this case, even if the plug connectors B are inserted into the receptacle A powerfully by excessively large forces, such forces are supported by the receptacle A after the plug connectors B and the receptacle A have been fitted. Therefore, it is needed to turn operator's attention to the inserting force.

However, when removal of the plug connectors, it is required to take care of removing force acting upon the plug connectors B. If the removal force is too large, the plug connectors B are forced away from the receptacle A too far after removal, with result that bundles of wires 9 connected to the plug connectors B are subjected to undesirable tensile forces and abrasion. Such a caution is not needed by the use of the removing levers 10 so that the ease in handling the connector according to the invention is more improved by the removing levers 10.

Moreover, the receiving cover 7 is formed at one end of at least one back cover mounting rib 7*b* with a hook-shaped protrusion 7*g* having a free end bent at right angles to itself as shown in FIG. 6*a*. On the other hand, the back cover 8 is formed at least one end of a rib forming at least one groove 8*b* with a short slit 8*e* for receiving the hook-shaped protrusion 7*g*. When the back cover mounting rib 7*b* is inserted in the groove 8*b*, the back cover 8 is positioned relative to the receiving cover 7 without any particular precaution so that the mounting of the back cover 8 can be simplified.

In this case, moreover, when the back cover mounting rib 7*b* is inserted into the grooves 8*b*, a tip end 7*h* of the rib forming the groove 8*b* of the back cover 8 is positioned inwardly of a hook 7'*g* of the hook-shaped protrusion 7*g*. Therefore, even if the back cover 8 is made of a resin which is easily deformed, the end of the back cover 8 securely engages the hook-shaped protrusion 7*g*. Accordingly, a phenomenon that the back cover 8 is deformed so as to ride over the hook-shaped protrusion 7*g* to make it inoperative as a stopper.

A hook 7' may be formed in the axial direction of the receiving cover 7 as shown in FIG. 6*c* by which the same effect can be accomplished. In case that the back cover 8 is made of a material difficult to be deformed, the protrusion 7*g* may be a simple projection as shown in FIG. 6*d* or 6*e*. In forming the protrusion 7*g* shown in FIG. 6*e*, a rib 7*b* is formed with two slits, and a part between the slits is raised away from a surface of the rib 7*b*.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A distribution connector including a collective receptacle having a plurality of unit receptacle connectors, and plug connectors to be fitted in the unit receptacle connectors, respectively, comprising a plug connector receiving cover having a U-shaped cross-section forming a plug connector base receiving portion for receiving bases of the plug connectors and having plug connector positioning openings for receiving fitting portions of the plug connectors arranged correspondingly to the unit receptacle connectors of the collective receptacle and back cover mounting ribs along outer edges of an opening of the U-shaped cover, and a back cover including a wire receiving portion having a U-shaped cross-section, back cover mounting rib receiving grooves along outer edges of an opening of the U-shaped back cover for receiving said back cover mounting ribs of the plug connector receiving cover and plug connector retaining ribs along inner edges of said opening of the U-shaped back cover, inserting the plug connectors into the plug connector receiving cover, fitting said back cover mounting ribs of the plug connector receiving cover in the back cover mounting rib receiving grooves of said back cover to embrace the bases of the plug connectors by means of edges of said plug connector positioning openings and the plug connector retaining ribs, thereby aligning and fixing the plug connectors.

2. A distributing connector as set forth in claim 1, wherein said distributing connector is provided with temporarily retaining means comprising projections formed on the plug connector base receiving portion of the plug connector receiving cover and recesses formed in the bases of the plug connectors for receiving the projections of the receiving cover.

3. A distributing connector as set forth in claim 2, wherein said recesses are straight grooves extending perpendicularly to fitting directions of the plug connectors.

4. A distributing connector as set forth in claim 1, wherein said plug connector receiving cover is provided at both ends with removing levers, each of the removing levers comprising a short arm and a long arm extending substantially in opposite directions and pivotally connected to the plug connector receiving cover so that when the lever is pivotally moved, the short arm of the removing lever is moved in a plug connector inserting direction to abut against a part of the collective receptacle fitted with the plug connectors and urge the collective receptacle away from the plug connector receiving cover.

5. A distributing connector as set forth in claim 1, wherein at least one back cover mounting rib of the plug connector receiving cover is provided with a protrusion as a stopper against which an end of a rib forming the back cover mounting rib receiving groove abuts.

6. A distributing connector as set forth in claim 5, wherein each of the back cover mounting ribs is provided with the protrusion as the stopper.

7. A distributing connector as set forth in claim 5, wherein said protrusion as the stopper has a tip end which is bent substantially at right angles to the protrusion to form a hook.

8. A distributing connector as set forth in claim 5, wherein the back cover is formed at least at one end of a rib forming the back cover mounting rib receiving groove with a short slit for receiving said protrusion as the stopper.

* * * * *